US011503934B1

(12) United States Patent
Wegner

(10) Patent No.: US 11,503,934 B1
(45) Date of Patent: Nov. 22, 2022

(54) APPARATUS AND METHOD FOR INSULATING A BEVERAGE CAN

(71) Applicant: Christopher C. Wegner, Winamac, IN (US)

(72) Inventor: Christopher C. Wegner, Winamac, IN (US)

( * ) Notice: Subject to any disclaimer, the term of this patent is extended or adjusted under 35 U.S.C. 154(b) by 0 days.

(21) Appl. No.: 17/000,782

(22) Filed: Aug. 24, 2020

Related U.S. Application Data

(63) Continuation of application No. 15/591,607, filed on May 10, 2017, now Pat. No. 10,750,892.

(51) Int. Cl.
*A47G 23/02* (2006.01)
*F25D 3/08* (2006.01)
*F25D 31/00* (2006.01)

(52) U.S. Cl.
CPC ..... *A47G 23/0233* (2013.01); *F25D 3/08* (2013.01); *F25D 31/007* (2013.01); *A47G 23/0208* (2013.01); *A47G 23/0216* (2013.01); *F25D 31/006* (2013.01)

(58) Field of Classification Search
CPC ..... A47G 23/0233; A47G 23/0208; A47G 23/0216; B25D 31/007; B25D 31/006
USPC ..... 220/739, 740, 793, 263, 592.71, 592.26, 220/592.25
See application file for complete search history.

(56) References Cited

U.S. PATENT DOCUMENTS 3,120,319 A * 2/1964 Buddrus ..... B65D 81/3886 215/12.2
D229,156 S * 11/1973 Moussette ..... D7/622
D273,247 S * 4/1984 Pigott ..... 224/240
4,494,672 A * 1/1985 Pearson ..... B65D 47/088 220/258.2
4,872,577 A * 10/1989 Smith ..... B65D 51/04 220/739
4,927,047 A * 5/1990 Stuber ..... B65D 81/3879 220/740
5,139,163 A * 8/1992 Diaz ..... B65D 51/20 220/258.2
5,186,350 A * 2/1993 McBride ..... A47G 23/0233 206/818
5,467,891 A * 11/1995 Perry ..... B65D 81/3886 220/739
6,039,207 A * 3/2000 Adamek ..... B65D 81/3879 215/303

(Continued)

*Primary Examiner* — J. Gregory Pickett
*Assistant Examiner* — Niki M Eloshway
(74) *Attorney, Agent, or Firm* — R. Randall Frisk

(57) ABSTRACT

For a beverage can having a lower portion, an upper portion and a greater diameter, a beverage insulation system for holding a beverage can includes a base with walls and a bottom that together form a base cup sized and configured to receive the lower portion of the beverage can; a lid with walls and a top that together form a lid cup sized and configured to receive the upper portion of the beverage can; a hinge assembly connecting the lid with the base to enable the lid to pivot between a closed position covering the upper portion of the beverage can received in the base cup and an open position uncovering the upper portion of the beverage can received in the base cup; and a generally cylindrical insert having an inner surface and being coaxially held within and by the lid cup to encircle the upper portion of the beverage can in the closed position.

25 Claims, 12 Drawing Sheets

(56) References Cited

U.S. PATENT DOCUMENTS

| | | | | |
|---|---|---|---|---|
| 6,206,223 | B1 * | 3/2001 | Wicker | B65D 81/3879 220/375 |
| 6,604,649 | B1 * | 8/2003 | Campi | B65D 81/3886 220/592.17 |
| 10,232,991 | B2 * | 3/2019 | Gemmill | B65D 43/16 |
| 2004/0149764 | A1 * | 8/2004 | Reeves | B65D 43/162 220/703 |
| 2012/0018442 | A1 * | 1/2012 | Bollis | B65D 81/3876 220/739 |
| 2014/0348976 | A1 * | 11/2014 | Aranda Campin | B65D 17/28 426/2 |
| 2017/0327280 | A1 * | 11/2017 | Alvarez | A47G 23/0233 |
| 2019/0150645 | A1 * | 5/2019 | Gemmill | B65D 81/3876 |

* cited by examiner

APPARATUS AND METHOD FOR INSULATING A BEVERAGE CAN

CROSS-REFERENCE TO RELATED APPLICATIONS

This application is a continuation of patent application Ser. No. 15/591,607, filed May 10, 2017, which application is hereby incorporated by reference.

FIELD OF THE INVENTION

The present invention relates to the field of insulators for beverage cans, and more specifically, to beverage can insulators with hingedly connected lids.

BACKGROUND OF THE INVENTION

Beverage cans are metal containers designed to hold a fixed amount of a beverage, such as soda, beer, fruit juice, tea, and so on. Worldwide, greater than 350 billion cans are produced per year, the majority of which are made of aluminum. Unfortunately, metal is a good conductor of heat and, once removed from cold storage, a chilled can of a beverage will warm to the surrounding temperature very quickly. Beverage can insulators (known by many names, such as can coolers, candoms, huggers, huggies and koozies, to name a few), usually comprise a foam sleeve that is sized to surround and thermally insulate the can. The typical koozie will cover the lower approximately 70% of the can, leaving the top 30% exposed so the user can freely access and drink from the opening at the top of the can. Of course, the exposed top can portion permits the unrestricted heating of the can and its contents, as well as permitting dirt and other debris, or worse, bugs, to cover and enter that drink opening.

Koozie tops, lids and covers of some form have been developed to cover the can top, such as are shown in the following U.S. Patents and Patent Publications:

| Pat./Pub. No. | Inventor |
|---|---|
| 9,038,850 | Wilson |
| 7,677,056 | Panganiban |
| 6,860,399 | Reeves |
| 6,789,693 | Lassiter |
| 6,206,223 | Wicker |
| 6,039,207 | Adamek |
| 5,740,951 | Jack |
| 5,740,940 | Weiss |
| 5,325,988 | Ekern |
| 5,139,163 | Diaz |
| 5,078,296 | Amidzich |
| 4,927,047 | Stuber |
| 4,872,577 | Smith |
| 4,494,672 | Pearson |
| 4,194,627 | Christensen |
| 3,905,511 | Groendal |
| 3,023,922 | Arrington et al. |
| D675,881 | Wamack, Jr. |
| D530,984 | Bolden |
| D474,650 | Reeves |
| D347,973 | McBride |
| US2011/0220670 A1 | Poole et al. |
| US2007/0149764 A1 | Reeves |
| US2004/0061208 A1 | Boyd |
| WO2004065230 | Reeves |

While these koozie tops help keep the can better insulated and protected from bugs and debris, improvements in convenience and ease of use can be made.

SUMMARY OF THE INVENTION

Generally speaking, a beverage insulation system is provided for holding and insulating a beverage can and for covering the opening of the can.

In one embodiment, where a beverage can has a lower portion, an upper portion and a greater diameter, a beverage insulation system for holding the beverage can includes a base with walls and a bottom that together form a base cup sized and configured to receive the lower portion of the beverage can; a lid with walls and a top that together form a lid cup sized and configured to receive the upper portion of the beverage can; a hinge assembly connecting the lid with the base to enable the lid to pivot between a closed position covering the upper portion of the beverage can received in the base cup and an open position uncovering the upper portion of the beverage can received in the base cup; and a generally cylindrical insert having an inner surface and being coaxially held within and by the lid cup to encircle the upper portion of the beverage can received in the base cup and in the closed position.

It is an object of the present invention to provide an improved system for holding, insulating and protecting a beverage can.

Further objects and advantages of the present invention will become apparent from the following description of the preferred embodiment.

DESCRIPTION OF THE PREFERRED EMBODIMENT

Figure 2:
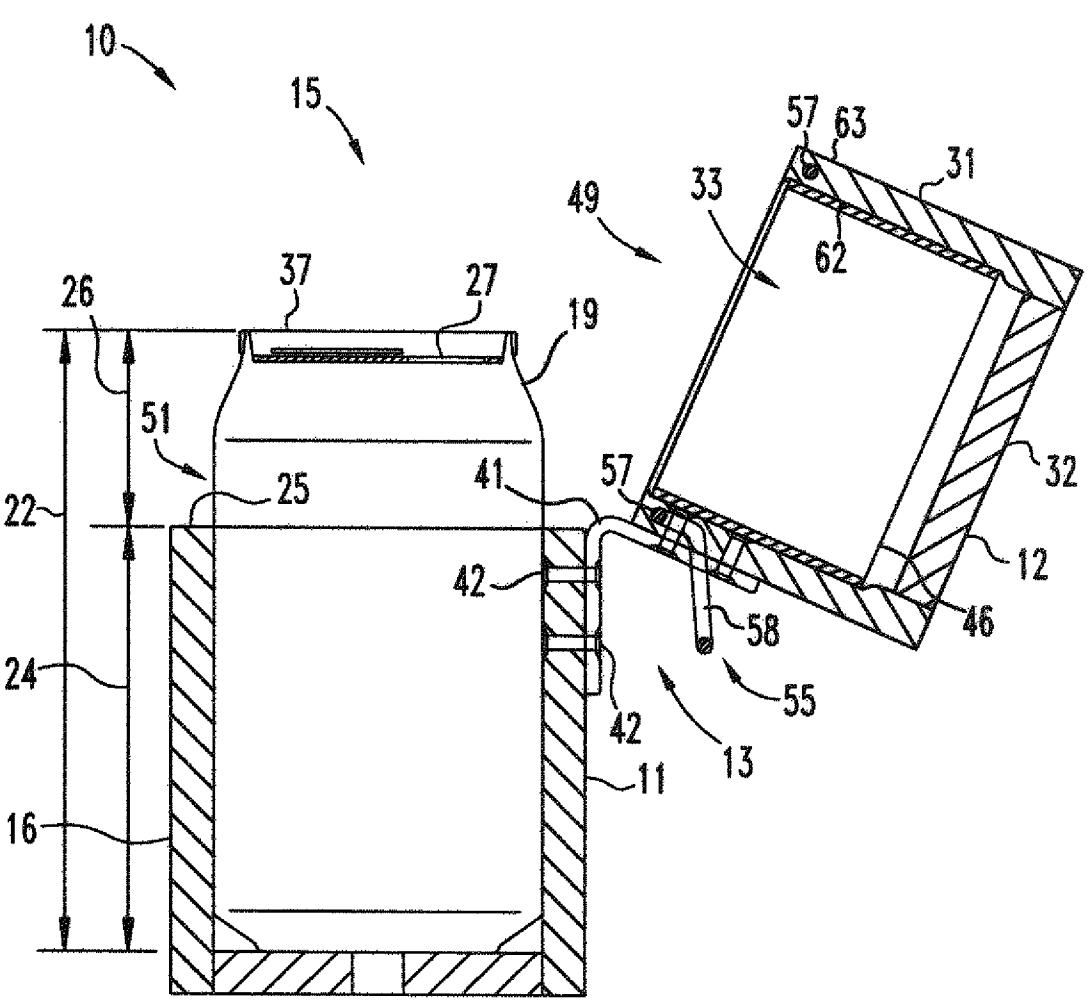
FIG. 2 is a side, diametrical cross-sectional view of the beverage insulation system 10 of FIG. 1, and shown in the open position 15.

For the purposes of promoting an understanding of the principles of the invention, reference will now be made to the embodiment illustrated in the drawings and specific language will be used to describe the same. It will nevertheless be understood that no limitation of the scope of the invention is thereby intended, and any alterations and modifications in the illustrated device, and further applications of the principles of the invention as illustrated therein are herein contemplated as would normally occur to one skilled in the art to which the invention relates.

Figure 1:
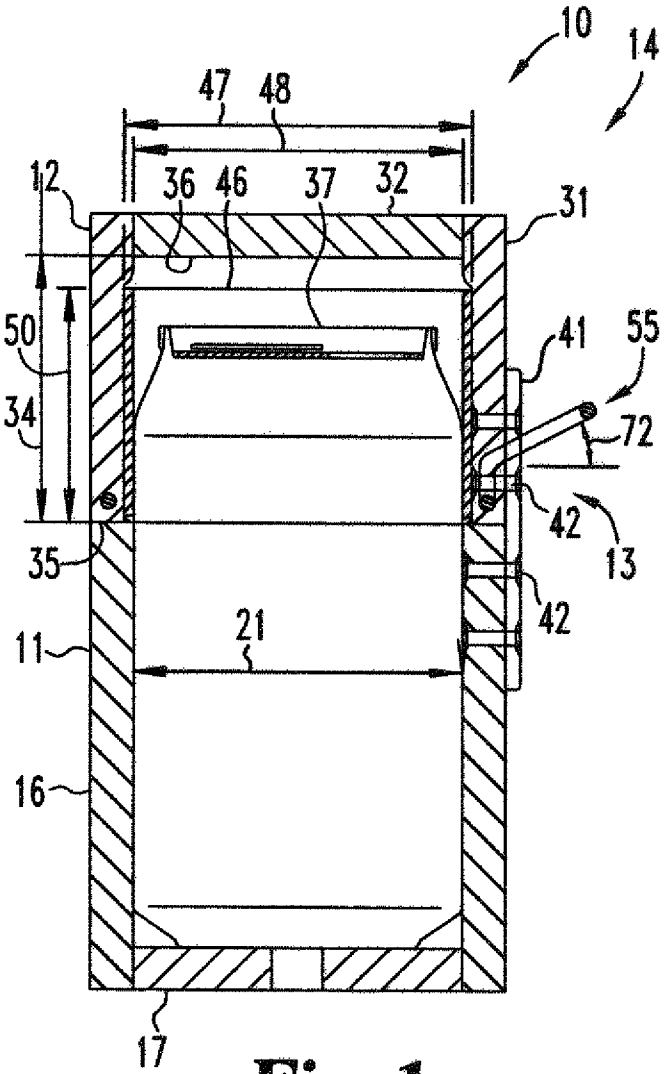
FIG. 1 is a side, diametrical cross-sectional view of a beverage insulation system 10 in accordance with one embodiment of the present invention, shown in the closed position 14, and shown holding a beverage can 19.
Figures 3, 4, 4A, 5:
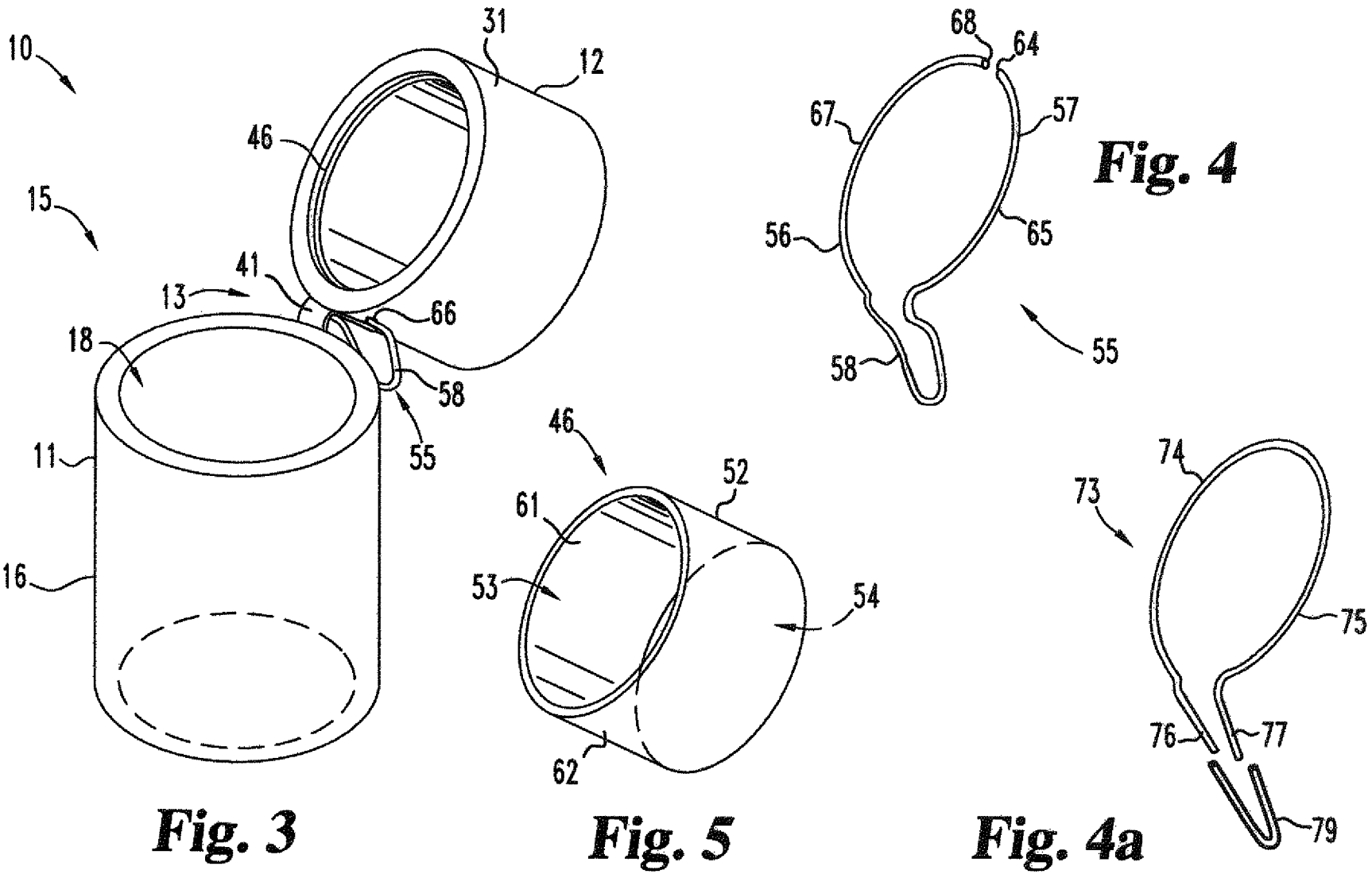
FIG. 3 is a perspective view of the beverage insulation system 10 of FIG. 2 and shown without the beverage can 19.
FIG. 4 is a perspective view of the finger lever 55 of the beverage insulation system 10 of FIG. 3 before it has been assembled with the lid body 31.
FIG. 4*a* is a perspective view of a finger lever 73 in accordance with another embodiment of the present invention.
FIG. 5 is a perspective view of the insert 46 of the beverage insulation system 10 of FIG. 2.

Referring to FIGS. 1 through 3, there is shown a beverage insulation system 10 in accordance with the present invention. System 10 generally includes an insulating base 11 and a lid 12 that is hingedly connected to base 11 by a hinge assembly 13 that allows lid 12 to be hingedly moved between a closed position 14 (FIG. 1) and an open position 15 (FIGS. 2 and 3). Base 11 is like known beverage insulators (koozies) and comprises a cylindrical body (also referred to as walls) 16 and a bottom (generally a disc) 17 that is connected inside of and at the bottom of body 16. Body 16 and disc 17 together form a base cup (a cavity) with an opening 18 at its top and that is sized to coaxially and snugly receive the lower portion of a standard beverage can 19 therein, as shown. Body 16 and bottom disc 17 are made of a spongey, foam (or foam-like) material such as neoprene, scuba, EVA, polyester, vinyl or any appropriate type of open-cell and closed-cell foam. Such material is spongey in that it is somewhat deformable, compressible and elastic. The foam or foam-like material of base 11 of FIG. 1 is often referred to as hard foam, with a wall thickness of about ¼ to ⅜ inches. This hard foam material is of the type that makes base 11 stand on its own, without a can inside it, and means that base 11 will resume its normal, pre-formed shape after being bent, stretched or compressed. These materials, in addition to being easy to grip and comfortable to hold, also exhibit good thermal insulation so as to insulate a beverage can 19 contained within the base 11. The inner diameter of body 16 is about the same or slightly less than the outer diameter of a standard, generally cylindrical beverage can 19 (at its widest region, referred to as the can's greater diameter, as at 21), which is about 2.6 inches. The beverage can 19 can thus be telescopically pushed down into—and pulled up out of—base 11 with the application of a moderate amount of force. Such close tolerance fit between can 19 and body 16, even when the can exterior is wet and the coefficient of friction between can 19 and body 16 is then likely at its lowest, causes base 11, during normal use, to stay firmly (snugly) "connected" to its can 19 until it is forcibly removed therefrom.

The height 22 of a standard beverage can 19 in the U.S. is about 4.8 inches. The height of base 11 and the thickness of the bottom disc 17 vary somewhat from one koozie style to another, but generally the inner height 24 of the koozie body 11 is about 3.4 inches so that when can 19 is received within base 11, about 1.4 inches (about 29%) of the can 19 extends above the top edge 25 of cylindrical body 16 (the "can rise" 26) to permit the user to access and drink from the opening 27 in the top of the can 19. Of course, both the can 19 and base 11 may come in different sizes than described above, and the present invention is contemplated to be sized and shaped to operatively fit with whatever can and koozie is intended to be used.

Lid 12 is similar to base 11 in that it is an inverted, shorter version of base 11, with a cylindrical body (walls) 31 and a top (here, disc-shaped) 32 connected to, within, and at the top of body 31, and both body 31 and top 32 are also made of a spongey, foam or foam-like insulating material, here the same as that of base 11. The walls 31 and top 32 thus form a lid cup (lid 12 is cup-shaped, thus defining a cavity) with a downwardly facing (when in the closed position 14) opening 33. Lid 12 has radial dimensions that are the same or roughly the same as that of base 11, and it has an inner clearance height 34 (from the bottom edge 35 of body 31 to the bottom surface 36 of disc top 31, that is at least slightly greater than the can rise 26. Lid 12 can thus be moved to its closed position 14 where bottom lid edge 35 rests almost entirely, if not entirely, against top base edge 25, and where lid 12 and base 11 together envelope the can 19 that has been inserted into base 11, and preferably where the top rim 37 of can 19 does not contact the bottom surface 36 of lid 31, as shown.

Lid 12 is connected to base 11 to permit lid 12 to be hingedly moved between the closed and open positions 14 and 15 by the hinge assembly 13. Hinge assembly 13 in its simplest form is a hinge strap 41—a piece of flexible material securely connected by rivets 42 (or by stitching, glue, staples, or any other appropriate connection device or method) to the outside top of the base 11 and the outside bottom of the lid 12, as shown. Being securely connected means strap 41 is connected to base 11 so that it cannot be easily disconnected without tools, without use of a great deal of force (considerably more than would be exerted during normal use of the invention) or without causing damage to the attendant parts. Strap 41 of hinge assembly 13 can be of any appropriate material, may be connected to and on the outsides, insides, within or to or on any other appropriate locations of base 11 and lid 12, and may be connected to base 11 and lid 12 by any appropriate fasteners or fastening device, all to flexibly connect and allow lid 12 to hingedly move between the closed and open positions 14 and 15.

Lid 12 further includes an insert 46 that is essentially a cylinder with walls 52 and opposing openings 53 and 54, and which is sized and shaped to snugly and coaxially fit within the lid cylindrical body 31. Insert 46 may be physically connected to body 31 as with an adhesive or a fastening mechanism or, in the preferred embodiment, its outer diameter 47 is simply sized larger than the relaxed inner diameter 48 of lid body 31. Insert 46 is then telescopically pushed into lid body 31, whereby the spongey nature (somewhat deformable, compressible and elastic) of lid body 31 allows it to be outwardly deformed, and whereby its elastic nature now firmly grips and holds insert 46 in the fully inserted position 49, as shown. In the preferred embodiment, insert 46 is preferably made of plastic, which is lightweight and inexpensive, or any appropriate material that is similar to plastic in being both harder than and slipperier than the foam-type material of which lid 12 is made. That is, insert 46 allows lid 12 to engage with can 19 and, with little or no resistance, move along and past such engagement to its closed position 14. For purposes of comparison, where the coefficient of friction between one type of rubber (akin to the foam material of lid body 31) and various types of steel in a dry environment is in the range of 0.50 to 0.85, the coefficient of friction between steel and various plastics in a dry environment is in the range of 0.20 to 0.4. In one embodiment, the material for insert 46 may be selected to give a coefficient of friction (in a dry environment) between an aluminum beverage can 19 (at its top rim 37) and the inside surface of insert 46 of less than about 0.4, and preferably less than about 0.3. Of course, the present invention strives to make the insert of any material that lowers the coefficient of friction between can 19 and the inside of lid 12, but lowering that coefficient of friction as much as possible, while not appreciably adding to the cost, weight or complexity of the beverage insulation system is preferred.

The inner diameter of insert 46 is slightly larger than that of the target can 19 so that lid 12, with insert 46 fitted inside thereof, can easily be hingedly moved, via hinge assembly 13, to the closed position 14, and whereby insert 46, easily and with no or virtually no frictional resistance, is positioned down, over and around the top portion of can 19, as shown. In other embodiments, the inner diameter of insert 46 can be set to provide a slight amount of contact, and thus frictional resistance, with the widest portion of the upper can portion (at 51, for example) so that lid 12 can be easily moved to and away from the closed position 14, but also the slight frictional resistance at 51 there gently holds lid 12 at the closed position until manually and intentionally moved therefrom. In this and other embodiments presented herein, the entire inner surface 61 of insert 46 may be uniformly cylindrical, or the inner surface 61 may be at least generally cylindrical with portions thereof (e.g. dots, lines, ring(s), zig-zags, etc.) that extend slightly inwardly and are the only portions of insert 46 that, with little friction, engage and slide along the upper portion of the can 19 (that is, that portion of the can 19 that extends above top edge 25 when the lower portion of the can 19 is lowered into base 11) as lid 12 is moved between the closed and open positions 14 and 15. When in the closed position 14, insert 46 is thus positioned within lid 12 so that it encircles the upper portion (i.e. above 25, FIG. 2) of can 19. The inner surface 61 has a Mohs number of at least 4.0, and preferably at least 5.0.

The height 50 of insert 46 is, at most, equal to the inner height 34 of the lid cup. Alternatively, the insert height 50 may as little as practical (0.01 inches, for example, as in a ring), just so long is the insert 46 distances the upper can portion from the inner wall of the lid. It is preferred that the insert height 50 be at least about 0.5 inches, and the most preferred is the insert height be 1.0 inches or more to ensure that the can upper portion touches only the insert and not the lid inner wall.

Figure 19:
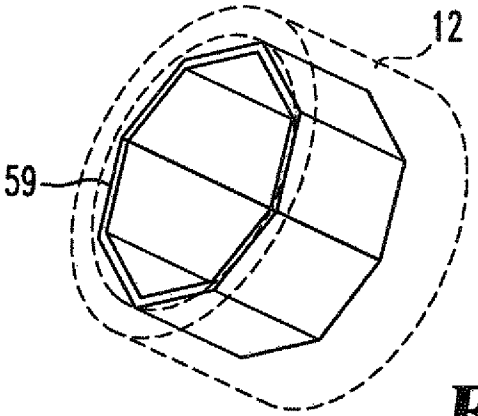
FIG. 19 is a perspective view of an insert 59 of the beverage insulation system 10 of FIG. 2 in accordance with another embodiment of the present invention.
Figure 20:
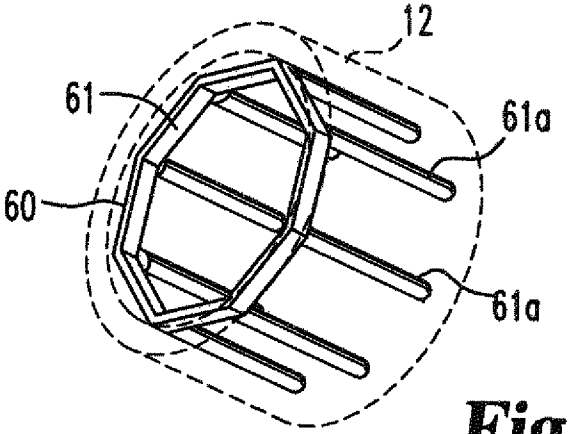
FIG. 20 is a perspective view of an insert 60 of the beverage insulation system 10 of FIG. 2 in accordance with another embodiment of the present invention.

While insert 46 is described as cylindrical, with an open bottom and open top, the present invention contemplates insert 46 to have or not have a constant radius, yet still be considered cylindrical for purposes of the present invention. For example, the insert may have an octagonal or decagonal or greater-sided cross-sectional configuration (see FIG. 19 showing an octagonal insert 59), or it may comprise a number of connected fingers—all generally parallel to the lid axis (see FIG. 20 showing an insert with a finger base 61 (round, octagonal or otherwise) and a plurality—at least three—of fingers 61*a* that extend into the lid 12)—and yet for purposes of this invention, it is still considered cylindrical in that it surrounds and contacts (or nearly contacts where there is a built in tolerance between such insert and the can 19) the upper portion of the beverage can 19 at circumferentially spaced intervals, all to provide the nearly frictionless contact between insert and can, instead of between the inside surface of lid body 31 and can 19, while lid 12 (with the insert) is moved between closed and open positions 14 and 15. In this regard, therefore, the insert (with the shape of insert 46 or otherwise) is referred to as generally cylindrical. The inner diameter of the insert is defined as the diameter of the largest cylinder that can coaxially slide into the insert. Thus, for an insert (i.e. insert 46) that is truly cylindrically shaped (is cylindrical, rather than generally cylindrical), its inner diameter is that of itself. But for an insert that is a hexagon having a side s, for example, its inner diameter is s times the square root of 3.

Referring to FIGS. 1-4, to facilitate the opening (and closing) action of lid 12, beverage insulation system 10 also includes a finger lever 55, which here comprises a rod (or wire, depending on the thickness selected) 56 that is formed to include a generally circular portion 57 and a lever portion 58. In one embodiment, rod 56 is bent to form the desired shape (FIG. 4), and lid body 31 is then formed around the bent rod 56 whereby the circular portion 57 extends through lid body 31 and near the body's bottom edge 35, as shown. It is preferred that rod 56 be as close to radially centered in lid body 31 so that it is not too close to either the inner or outer surfaces 62 or 63, respectively. Rod 56 could be a single, continuous loop formed as described above, or it could be as shown in FIG. 4, formed initially from a straight rod and extending from one end 64 in an arc (one part 65—generally a half—of circular portion 57 and embedded within lid body 31); then extending out through a hole 66 defined in lid body 31 and forming the generally U-shaped lever portion 58, then back in through another hole (not shown) in body 31 that is laterally positioned near its companion hole 66; then forming the other part 67—generally the other half—of circular portion 57; and ending at the opposite end 68. Rod 56 is thus firmly held by lid 12 so that rod 56 and its finger lever 55 move as a unit with lid 12. The lever portion 58 is contemplated to form an angle 72 with horizontal (when lid 12 is in the closed position 14 shown in FIG. 1) of between about zero degrees and 45 degrees, with a preference of about 30 degrees.

The user, with her fingers wrapped around the base 11, can easily then engage the lever portion 58 with her finger and pull downwardly, which pivots lid 12 via hinge 13 from the closed position 14 to the opened position 15, as shown. The insert 46 permits lid 12 to here be easily moved upwardly—without the typical resistance that would otherwise be experienced between the can 19 and the insulating material —off the upper portion of can 19 extending above top edge 25. Lid 12 is similarly closed by the user's finger (or thumb or hand, if desired) pushing upwardly on the lid 12 and/or lever portion 58 (as viewed in FIG. 2), whereby lid 12 pivots via hinge 13 back to its closed position 14. Again, insert 46 permits lid 12 to easily slide over the upper portion of the can 19 without typical can/insulation material resistance. This resulting beverage insulation system 10, which comprises a combination of base 11, lid 12, hinge assembly 13, insert 46 and finger lever 55, provides for convenient one-handed opening and closing of lid 12 over base 11 and the can 19 held therein.

Figure 15:
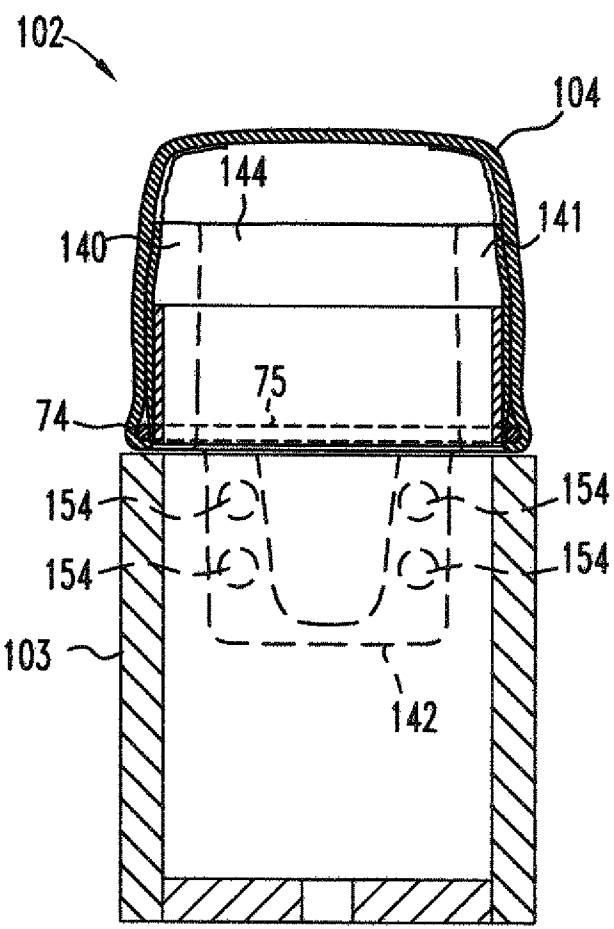
FIG. 15 is a rear, diametrical cross-sectional view of the beverage insulation system 102 of FIG. 14, and showing the hinge flap 142 in dashed lines.
Figure 14:
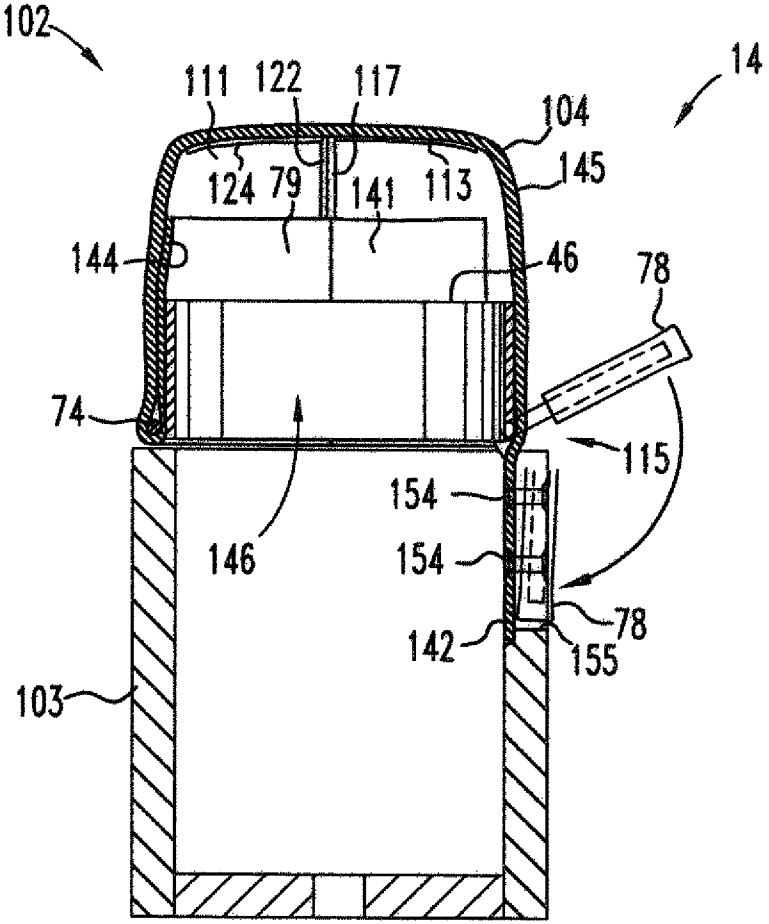
FIG. 14 is a side, diametrical cross-sectional view of a beverage insulation system 102 in accordance with another embodiment of the present invention, and shown in the closed position 14.

Referring to FIGS. 4*a*, 14 and 15, there is shown a finger lever 73 in accordance with another embodiment of the present invention. Finger lever 73 is like finger lever 55 except that the rod 74 is formed with a continuous circular portion 75 and its rod ends 76 and 77 form the frame for the lever portion 78. In addition, finger lever 73 includes a tubular finger member 79 that is made of rubber (or similar appropriate material) and its opposing ends are telescopically slid onto the rod ends 76 and 77 to form the U-shaped or V-shaped lever portion 78.

Figure 7:
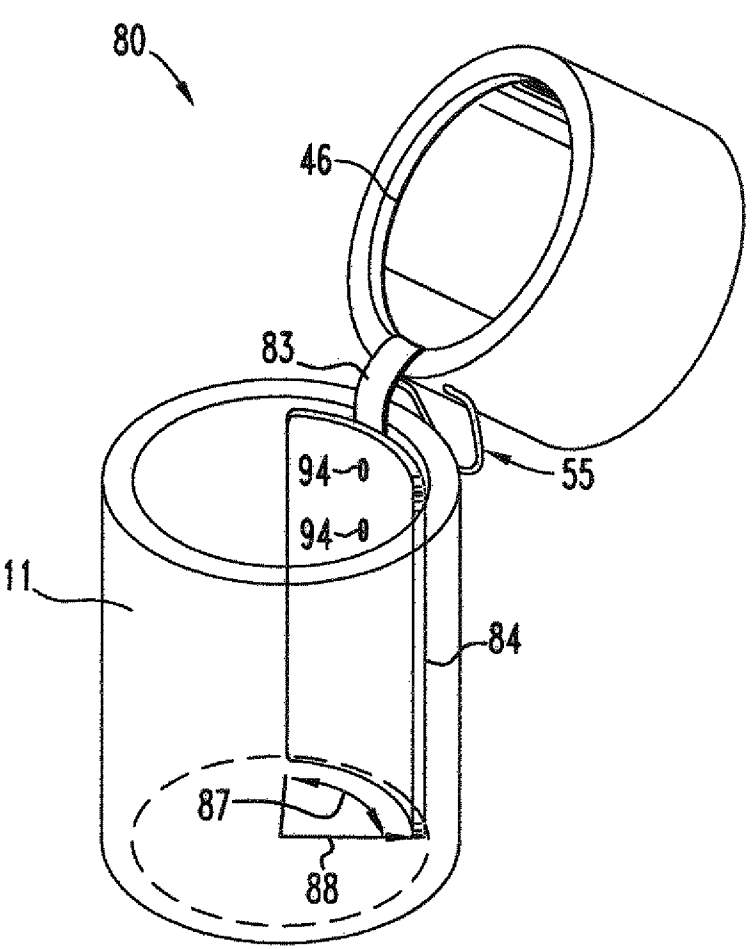
FIG. 7 is a perspective view of the beverage insulation system 80 of FIG. 6, and shown with the plate 84 of hinge assembly 83 positioned inside of koozie base 11.
Figure 6:
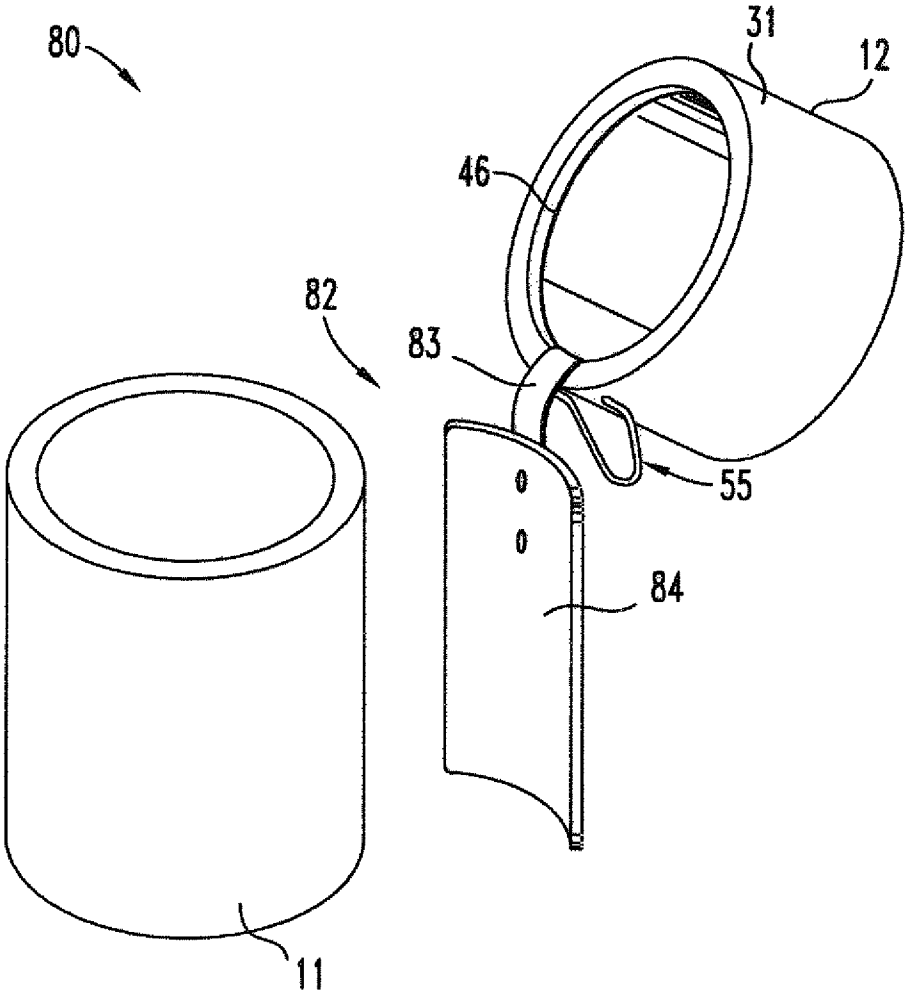
FIG. 6 is a perspective view of a beverage insulation system 80 in accordance with an alternative embodiment of the present invention, and shown with the lid 12 and hinge assembly 83 outside of koozie base 11.
Figure 8:
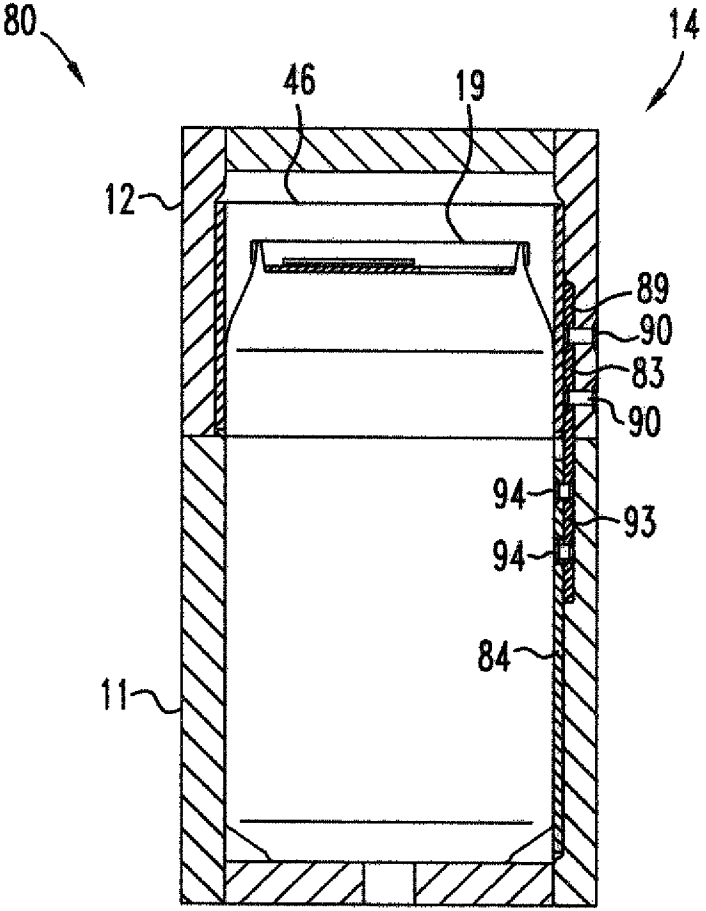
FIG. 8 is a side, diametrical cross-sectional view of the beverage insulation system 80 of FIG. 7, shown in the closed position 14, holding a beverage can 19, and without a finger lever 55.

Referring to FIGS. 6 through 8, there is shown a beverage insulation system 80 in accordance with another embodiment of the present invention. System 80 includes the same base 11, lid 12 and one or both of insert 46 and lever 55, and further includes a hinge assembly 82 that permits the lid to be easily and interchangeably used with any cup-shaped base similar to base 11. Hinge assembly 82 includes a hinge strap 83 and an anchor plate 84. Anchor plate 84 of the embodiment of FIGS. 6 and 7 subtends an angle 87 of about 90 degrees in a plane perpendicular to the axis of base 11 and to the cylindrical container 19 that is to be received within base 11. Plate 84, like insert 46, is made of any suitable material, such as plastic, that is durable enough and strong enough to withstand the intended uses described herein. It is also preferred that the insert be made of a material that is relatively hard and somewhat rigid—such as plastic or other synthetic or semi-synthetic organic compound, as opposed to the very soft material of most koozies. Making anchor plate 84 out of an appropriate plastic will enable plate 84 to bend somewhat and conform to a body 16 and/or can 19 that might be of slightly different diameter than plate 84. The thickness of plate 84 is desired to be thin and still provide a high degree of strength and resistance to failure during normal use. Plate 84 is contemplated to be between about 0.01 inches and 0.1 inches thick, with a preferred thickness of about 0.06 inches thick. The height of plate 84 could be the same or much less than the inner height 24 of base 11. In one embodiment, the height of plate 84 is only about 2.0 inches, and alternative embodiments are contemplated wherein the height is as little is 1.0 inches. Plate 84 has a radius of curvature 88 that is substantially identical to that to the outside of the standard beverage can at its vertical midsection, which in the U.S. is 1.3 inches. If beverage insulation system 80 is to be used with a can of smaller diameter, the plate 84 is contemplated to be correspondingly sized (i.e. roughly the same radial dimension as the target can).

Figure 9:
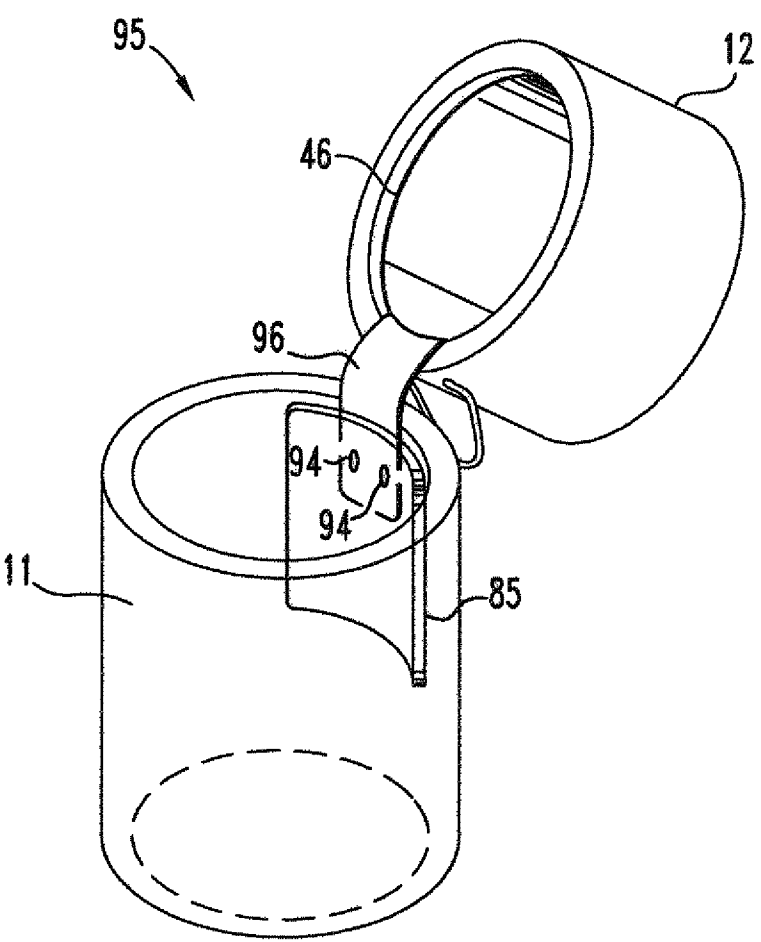
FIG. 9 is a perspective view of a beverage insulation system 95, in accordance with an alternative embodiment of the present invention.

Like hinge strap 41 of beverage insulation system 10, hinge strap 83 is a piece of flexible material enabling lid 12 to be pivoted onto and off of base 11 and the container 19 therein. And, like hinge strap 41, the top 89 of hinge strap 83 is securely connected by rivets 90 to lid 12, but here to the inside of lid 12. The bottom 93 of hinge strap 83 is likewise connected with rivets 94 to the outside of and roughly midway laterally of curved plate 84 and to the inside of base 11. In FIG. 9 there is shown a beverage insulation system 95 in accordance with another embodiment of the invention. In system 95, the hinge strap 96 is wider; the plate 85 is shorter (about 1.5 inches high); and the rivets 94 connecting hinge strap 96 to plate 85, instead of being in a vertical alignment (FIG. 7), are in a horizontal alignment.

In use, the curved anchor plate 84 of hinge assembly 82 (or plate 85 of beverage insulation system 95) is fully or partially inserted into the koozie base 11 before or simultaneously while inserting the beverage can 19 so that the curved plate becomes sandwiched between base 11 and can 19, as shown. When plate 84 is in position—between base body 16 and can 19 and with its top edge just at or below the top edge 25 base body 16—plate 84 is securely held thereat, and lid 12, hingedly connected to plate 84 (or 85), is now hingedly connected to the koozie base 11.

There are only two rivets shown connecting strap 83 (or 96) to lid 12 at the top and to plate 84 (or 85) at the bottom, but other configurations are contemplated as would provide additional strength and lateral stability. For example, there may be three or four such rivets at one or both the top and bottom, the rivets being not all in vertical and/or horizontal alignment, thus providing an added degree of stability.

Figure 12:
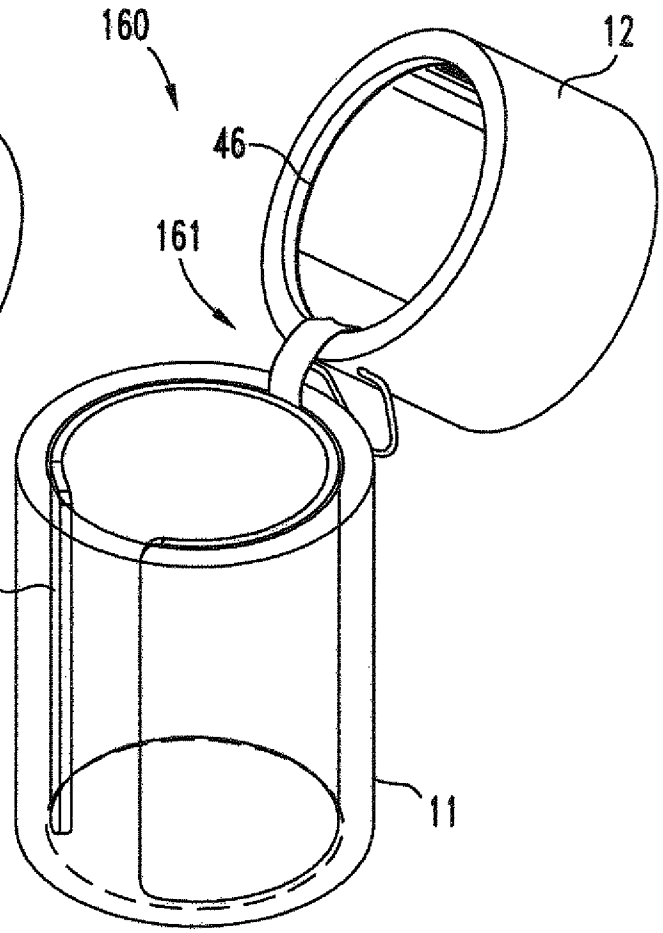
FIG. 12 is a perspective view of the beverage insulation system 160 of FIG. 11, and shown with the plate 162 of its hinge assembly 161 positioned inside of koozie base 11.

Alternative embodiments are contemplated wherein anchor plate 84 has yet other configurations and sizes than that shown in FIGS. 6 through 9. For example, the anchor plate can subtend a much narrower angle (as shown in the beverage insulation system 100 of FIG. 10 with a hinge assembly 102 and its narrow plate 97 subtending an angle of about 20 degrees, or a much larger angle as shown in the beverage insulation system 160 of FIGS. 11 and 12 with a hinge assembly 161 with plate 162 subtending an angle of about 300 degrees. Having the anchor plate subtend an angle of between about 70 degrees and 180 degrees, with a preferred subtended angle of about 120 degrees, affords good lateral stability of lid 12 (relative to base 11) balanced against minimum interference between can 19 and base 11 when can 19 is inserted into base 11. Anchor plate 84 could also be made in the form of a full cylinder, similar to insert 46 for lid 12. The invention contemplates an anchor member having any shape and any size capable of being sandwiched between the beverage can 19 and the insulation base 11 sufficient to firmly hold the lid 12 in place during normal use.

Figure 10:
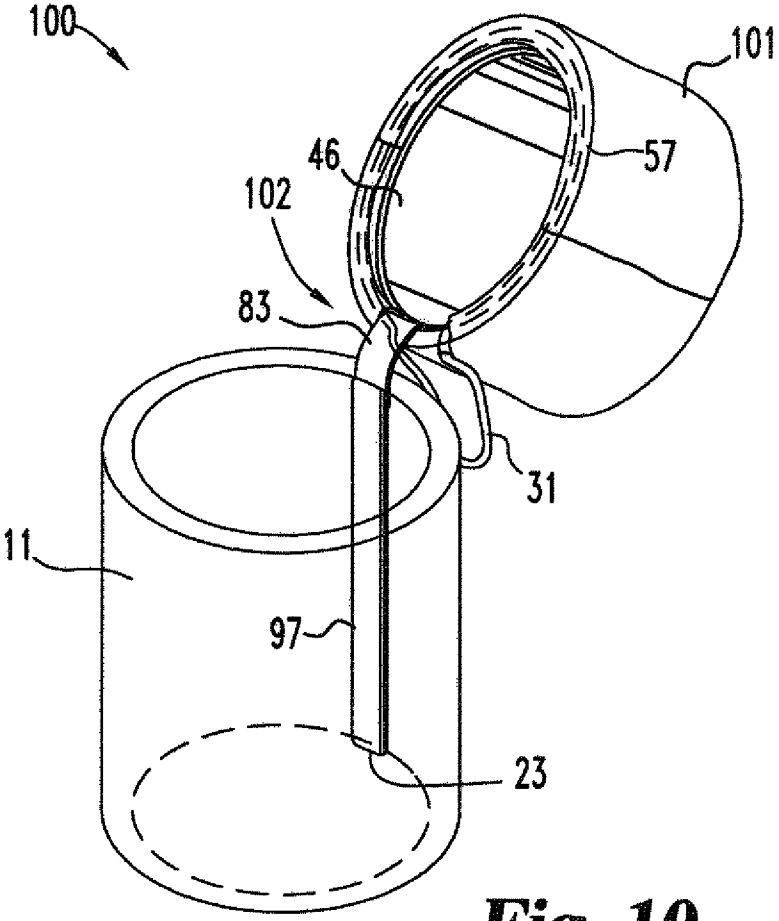
FIG. 10 is a perspective view of a beverage insulation system 100 in accordance with an alternative embodiment of the present invention, and shown with the plate 97 of the hinge assembly 102 positioned inside of the koozie base 11.
Figure 11:
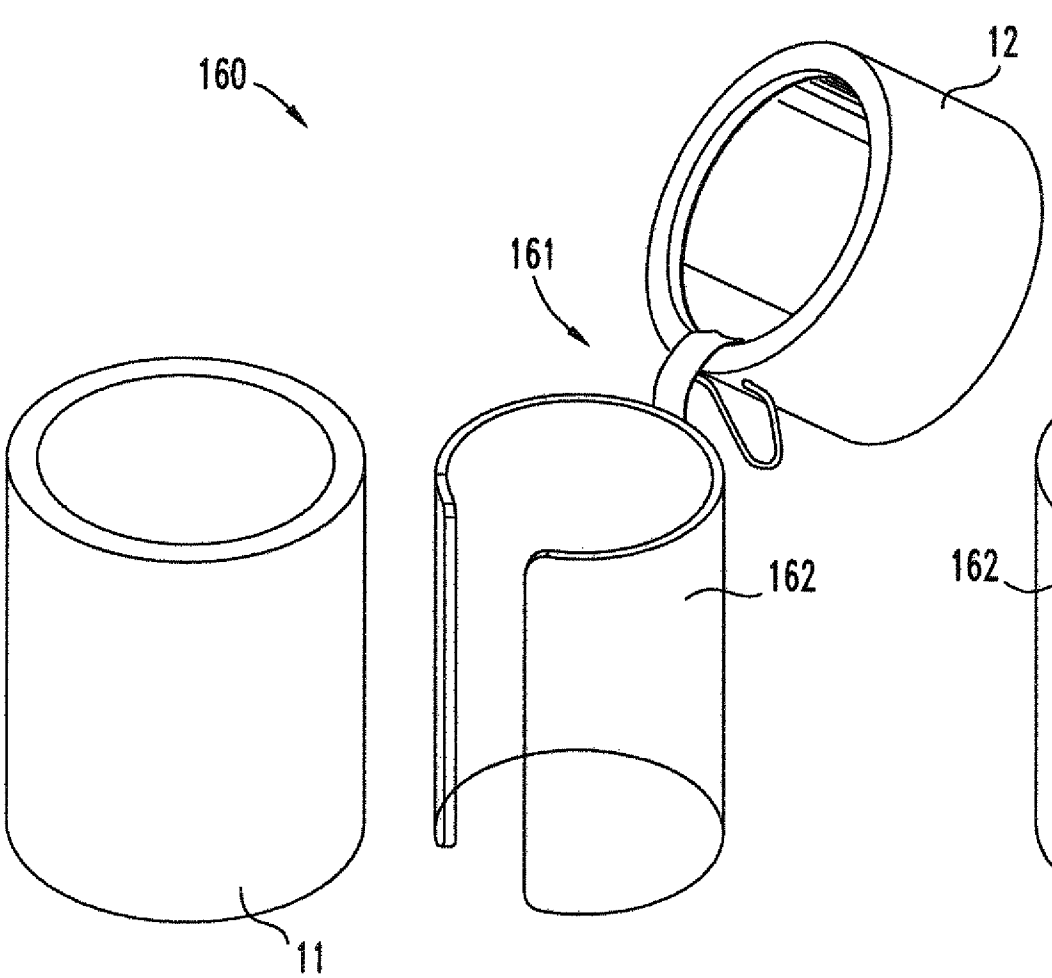
FIG. 11 is a perspective view of a beverage insulation system 160 in accordance with an alternative embodiment of the present invention, and shown with the lid 12 and hinge assembly 161 outside of koozie base 11.

Beverage insulation systems 10, 80, 95 and 160 comprise bases 11 and lids 12 in a molded form factor, that is, with a generally perfect cylindrical shape and made from hard foam, as discussed above. Alternative embodiments are contemplated wherein either or both of the base 11 and lid 12 are formed from more flexible, fabric-like insulating material wherein a generally flat piece of the material is cut into a blank and formed into the desired cylindrical body shape, with its edges then sewn or otherwise connected together. One such alternative embodiment is shown in FIG. 10 where the beverage insulation system 100 is substantially identical to the beverage insulation system 10 of FIGS. 1 through 3, except that the lid 101 is made not of hard foam, but from a flat blank of a more flexible, spongey material, such as neoprene, EVA, scuba, polyester, vinyl, or other similar material, which is then formed into the desired cup-like shape (like lid 12). Such material is like a fabric that can be cut, bent and formed from a flexible sheet and then attached to itself (or other materials) at appropriate places with appropriate connection means/methods such as glue, staples, sewing, etc. to form a desired shape.

Figures 13, 13A:
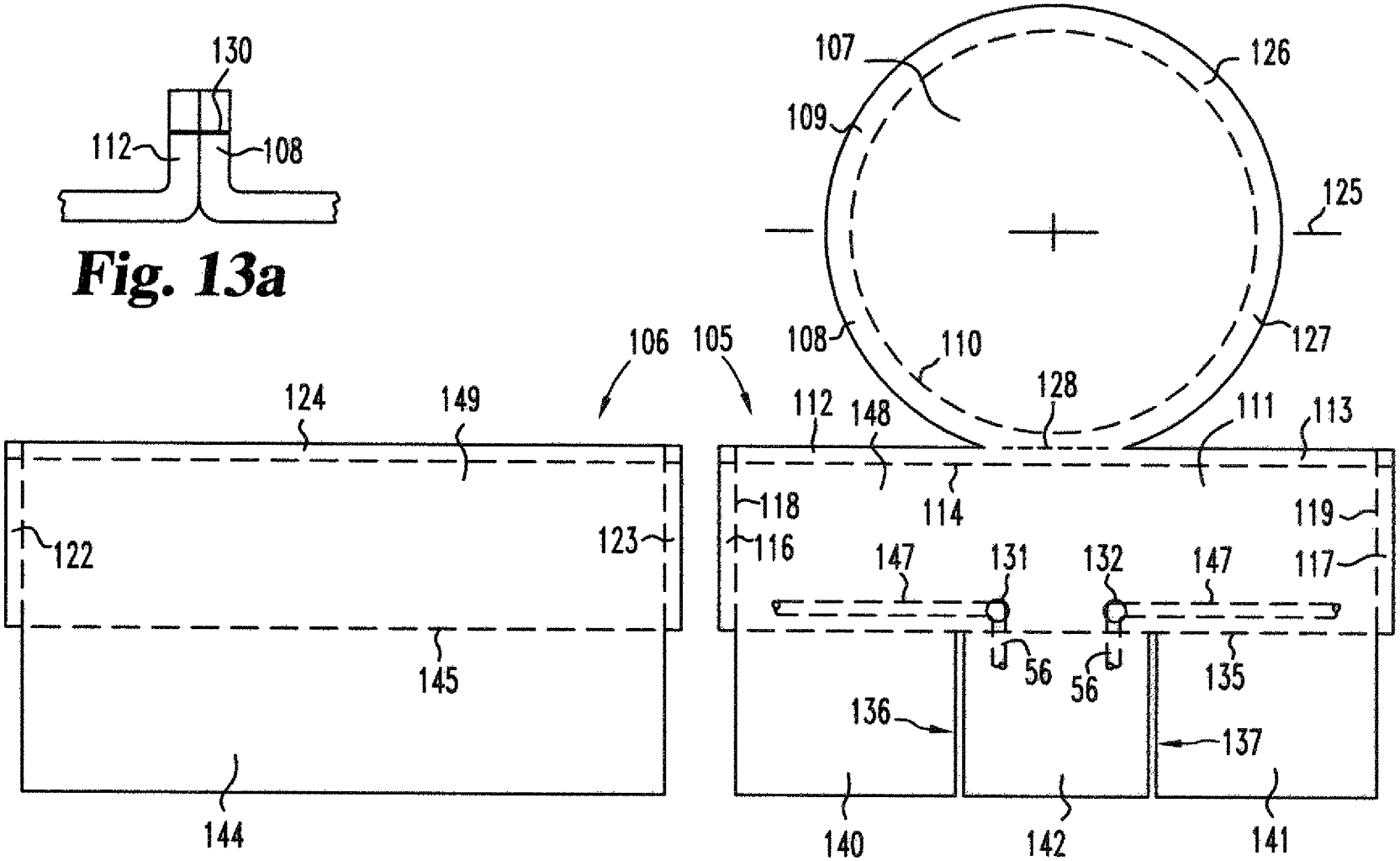
FIG. 13 is a plan view of blanks 105 and 106 that are formed to create lid 101 of FIG. 10, as well as lid 104 of FIG. 14.
FIG. 13*a* is a fragmented view of a portion of the seam portions 108 and 112 connected together in an abutting configuration.

Referring to FIGS. 13-17, there is shown a beverage insulation system 102 in accordance with another embodiment of the present invention. System 102 has a base 103, lid 104 and hinge assembly 115. Base 103 is nearly identical to base 11 of system 10, except as described below, and its lid 104 is formed from the more flexible insulating material like that of lid 101 of the system 100 of FIG. 10. Lid 104 is formed by creating a main blank 105 and a second blank 106, both of neoprene (other suitable, flexible, fabric-like and insulating material—i.e. not hard foam), in the shapes generally as shown in FIG. 13. The circular top portion 107 of main blank 105 defines an outer seam portion 108, which is merely a narrow band along the outer edge 109 of portion 107 (as indicated by dashed line 110) at which circular top portion 107 is sewn (or connected in any other appropriate manner, such as gluing) to the rectangular wall portion 111, therebelow. Rectangular wall portion 111 likewise defines left and right top outer seam portions 112 and 113 (on opposite sides of top portion 107 and as indicated by dashed line 114), at which rectangular portion 111 is connected (by sewing, gluing, etc.) to circular top portion 107. Rectangular wall portion 111 also defines side seam portions 116 and 117 (as indicated by dashed lines 118 and 119), at which rectangular wall portion 111 is connected (by sewing, gluing, etc.) to second blank 106 (at its similarly existing opposing side seam portions 122 and 123. Second blank 106 further defines a top seam portion 124, at which it is connected (by sewing, gluing, etc.) to the outer (roughly) top half 126 (above mid line 125, as viewed in FIG. 13) of top seam portion 108. In assembly, top portion 107 is folded (along line 128) toward the rectangular portion 111, and the lower half 127 (below line 125, as viewed in FIG. 13) of outer seam portion 108, and the corresponding top outer seam portions 112 and 113 of rectangular portion 111 are connected together in corresponding alignment. Then, the top seam portion 124 of second blank 106 and the top half 126 of outer seam portion 108 are connected together in corresponding alignment, and the opposing side seam portions 116 and 117 are similarly connected to the corresponding side seam portions 122 and 123 (116 to 123 and 117 to 122). The above-described connections are all to be abutting (as opposed to overlapping), as shown with seam portion 108 and seam portion 112 sewn together (at 130), for example, in FIG. 13*a*. All the seam portion connections are to be on the same side of the blanks 105 and 106 so that the resulting connected blanks 105 and 106 can then be inverted, which results in a cup-shaped member (substantially like the one shown in FIG. 10), with the various seam portions 108, 112, 113, 116, 117, 122, 123 and 124 all residing on the inside thereof.

Next, the ends 64 and 68 of shaped rod 56 (FIG. 4) are passed through holes 131 and 132 so that the entire circular portion 57 is on the inside of the cup-shaped member. If finger lever 73 of FIG. 4*a* is used, its opposing ends 76 and 77 are passed from the inside of the cup-shaped lid member, through holes 131 and 132, so that the ends 76 and 77 angle upwardly (with the cup-shaped member opening downwardly) and the circular portion 75 is on the inside of the cup-shaped lid member. Tubular member 79 is then telescopically applied to its respective ends 76/77 to produce the lever portion 78 shown in FIGS. 14 and 15.

In main blank 105, below a fold line (at 135) and below seam portions 116 and 117, there is no extra seam portion material. And, below fold line 135, blank 105 is cut or separated at 136 and 137 to form outer infold flaps 140 and 141 and a central hinge flap 142. Fold line 135 is slightly below holes 131 and 132. In second blank 106, below a fold line (at 145) and below seam portions 122 and 123, there is no extra seam portion material, and the remaining material of second blank 106 forms infold flap 144.

Figure 17:
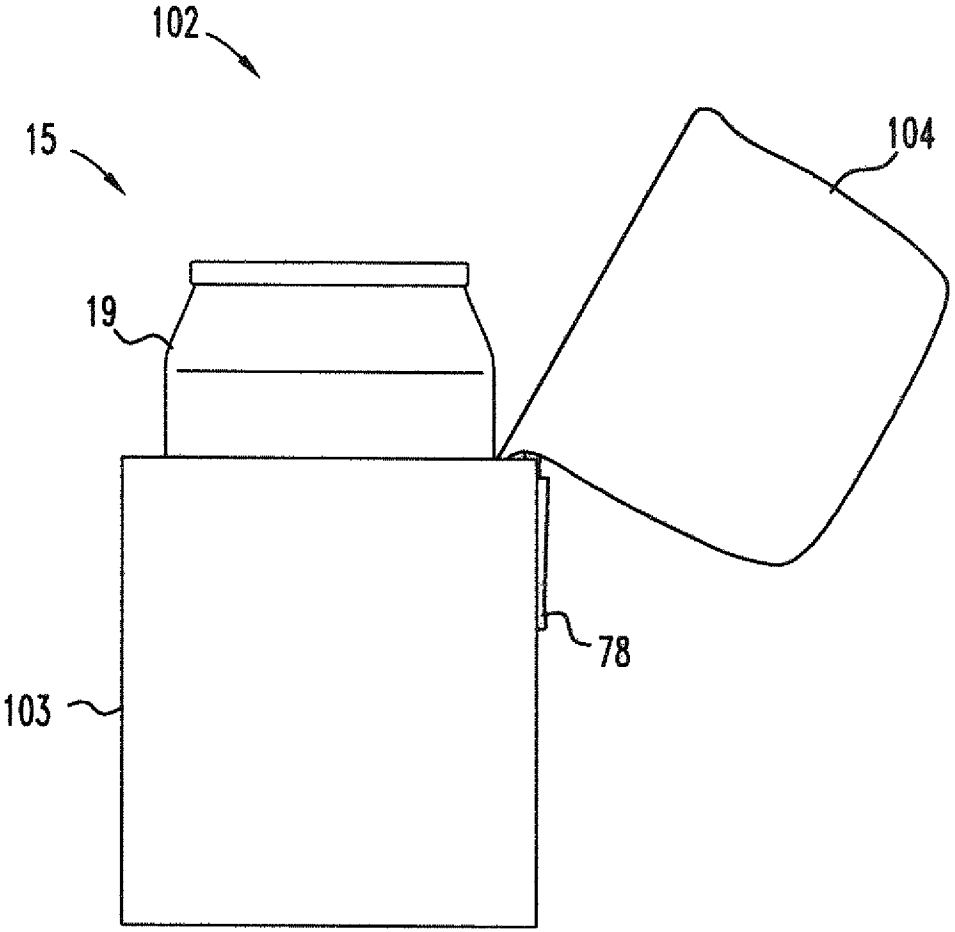
FIG. 17 side, elevational view of the beverage insulation system 102 of FIG. 16, and shown in the open position 15.
Figure 16:
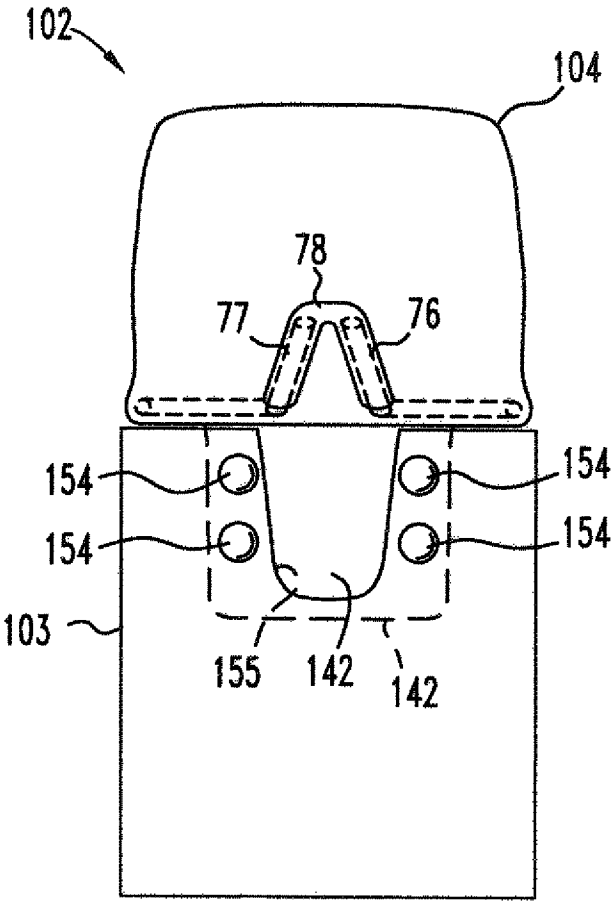
FIG. 16 is a rear, elevational view of the beverage insulation system 102 of FIG. 15, and showing the hinge flap 142 in dashed lines.

The final assembly step of the lid 104 is then folding the infold flaps 140, 141 and 144 up into the cavity 146 (FIG. 14) of the cup-shaped lid member 145, around the circular portion 75 of rod 74 (the relative positionment of which is shown in dashed lines at 147). The flaps 140, 141 and 144 are folded all the way in and against their corresponding upper sections 148 (of blank 105) and 149 (of blank 106) where they can be affixed by appropriate means, such as gluing, heat treatment, sewing, etc. Alternatively, mere insertion of insert 46 will serve to hold flaps 140, 141 and 144 in place, thus creating the lid 104 of FIGS. 14-17.

Where the beverage insulation system includes the lid being securely connected to its base, as lid 104 is securely connected to base 103 of system 102, the hinge flap 142 of blank 105 is secured to base 103 by appropriate means, which in the embodiment of FIGS. 14 and 15 is by rivets 154. The hinge flap 142 (of lids formed from blanks defining such flap 142) constitutes the "hinge strap" of the corresponding hinge assembly. Thus, hinge flap 142 of beverage insulation system 102 is the hinge strap of its hinge assembly 115. The base 103 of system 102 is provided with a U-shaped or V-shaped cutout (at 155) that is sized and configured to enable the lever portion 78 of finger lever 73 to swing down and into the cutout 155, which enables lid 104 to be opened as far as possible to the open position 15, as shown in FIG. 17. The hinge flap 142 is sized wide enough to extend beyond the needed width of cutout 155 and further to enable enough area outwardly of cutout 155 for hinge flap 142 to securely connect to base 103, here as with the rivets 154. It is noted that in the beverage insulation system 102 of FIGS. 14-17, the hinge assembly is the hinge flap 142 of the material forming its lid 104 and whatever connection means is used to connect such hinge flap 142 to base 103.

In the embodiment of FIG. 10, the top portion of hinge strap 83 is then affixed to the lid material, inside of the lid 12. Alternative embodiments are contemplated wherein the koozie base 11 is similarly made from a flexible blank and formed into a cylindrical shape to snugly receive a beverage can. The base 11 and lid 12 are referred to herein as cylindrical, which shape matches the standard beverage can and is preferred, but it is contemplated that either or both the base 11 and lid 12 may not be cylindrical and such non-cylindrical shapes are intended to be encompassed within the cylindrical base and lid body descriptions.

It is noted that, while less effective at maintaining the beverage can's temperature, a beverage insulation system in accordance with the present invention may be missing either or both of its bottom 17 and/or top 32, yet the walls of the base 11 and lid 12 are nevertheless intended to form a "lid" and/or "cup" within the meaning of invention.

Alternative embodiments are contemplated wherein anchor plate and hinge strap comprise one continuous element. For example, the hinge assembly may comprise a single hinge strap that is connected at its top end to lid 12 (as above) and is long enough to extend down into and be sandwiched between base 11 and the can 19, and such long hinge strap would be made of any appropriate material that permits the attached lid 12 to be hingedly moved between closed and open positions 14 and 15.

Figure 18:
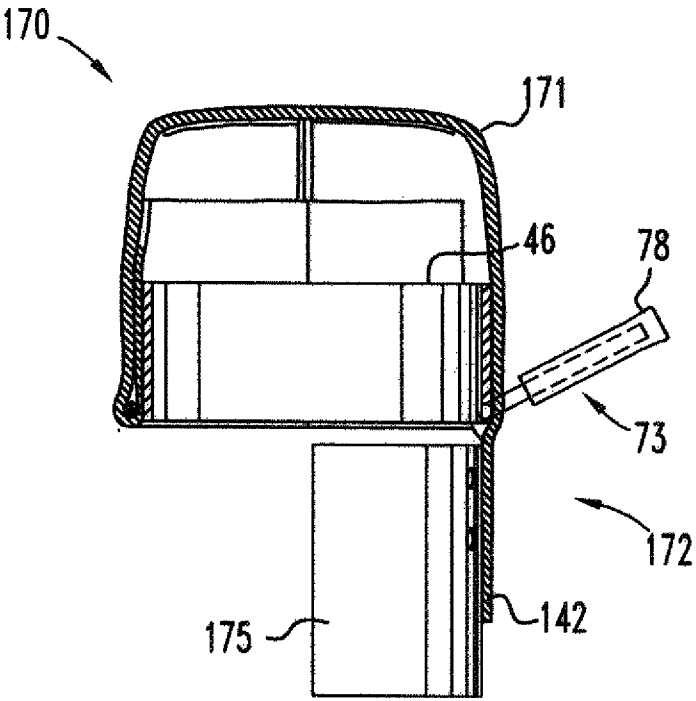
FIG. 18 is a side, diametrical cross-sectional view of a beverage insulation system 170 in accordance with another embodiment of the present invention.

In FIG. 18, there is shown a beverage insulation system in accordance with another embodiment of the present invention. Beverage insulation system 170 comprises just the lid 171 and hinge assembly 172, which is like the lid 104 of the beverage insulation system 102 of FIGS. 14-17, except instead of the hinge flap 142 being connected to the base 103, it is connected to an anchor plate 175 and can thus be used with any appropriate koozie base. Plate 175 is here about 2.0 inches high and subtends an angle of about 180 degrees. Beverage insulation system 170 also includes both an insert 46 and finger lever 73, but may include only one or neither of the insert 46 and finger lever 73. It is noted that in the beverage insulation system 170 of FIG. 18, the hinge assembly is the hinge flap 142 of the material forming its lid 104 and whatever connection means is used to connect such hinge flap 142 to anchor plate 175.

Figure 21:
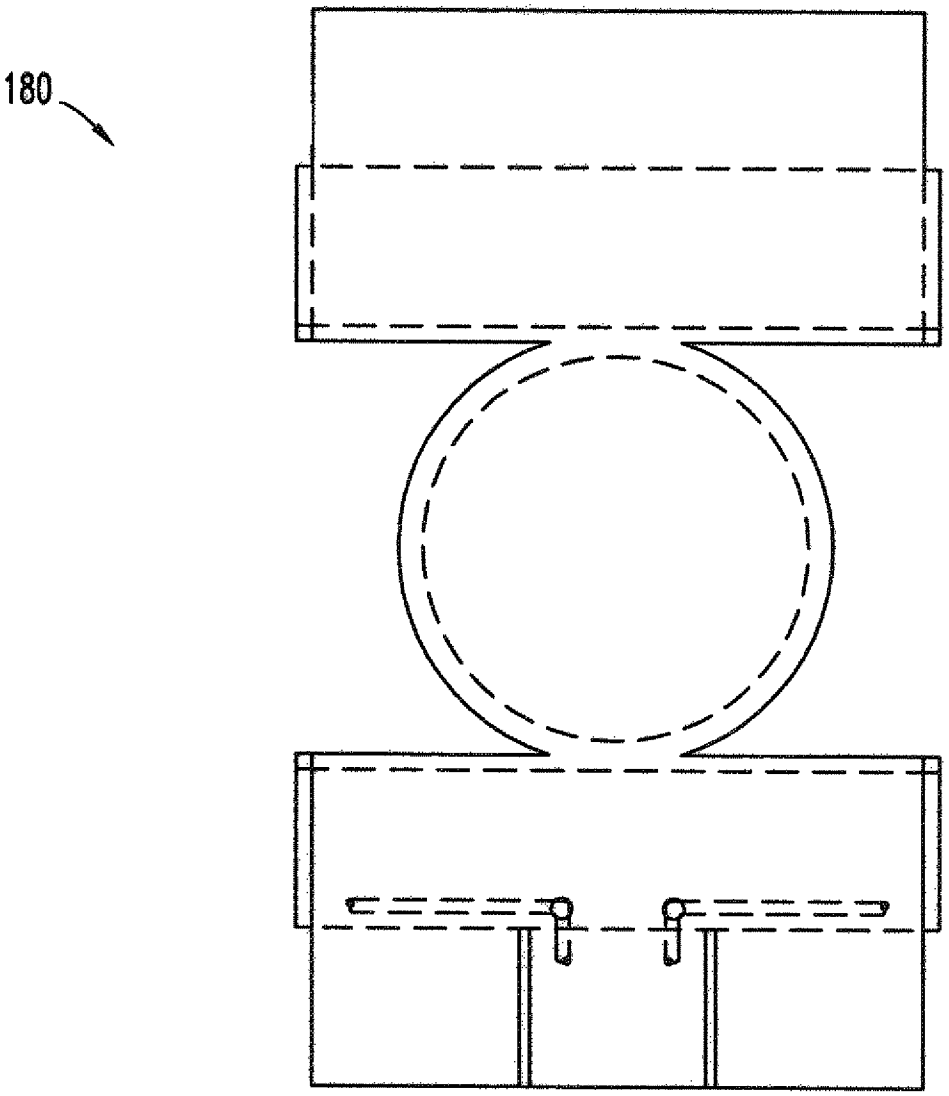
FIG. 21 is a plan view of a blank 180 that is formed to create lids 101 of FIG. 10 and lid 104 of FIG. 14 in accordance with another embodiment of the present invention.
Figure 22:
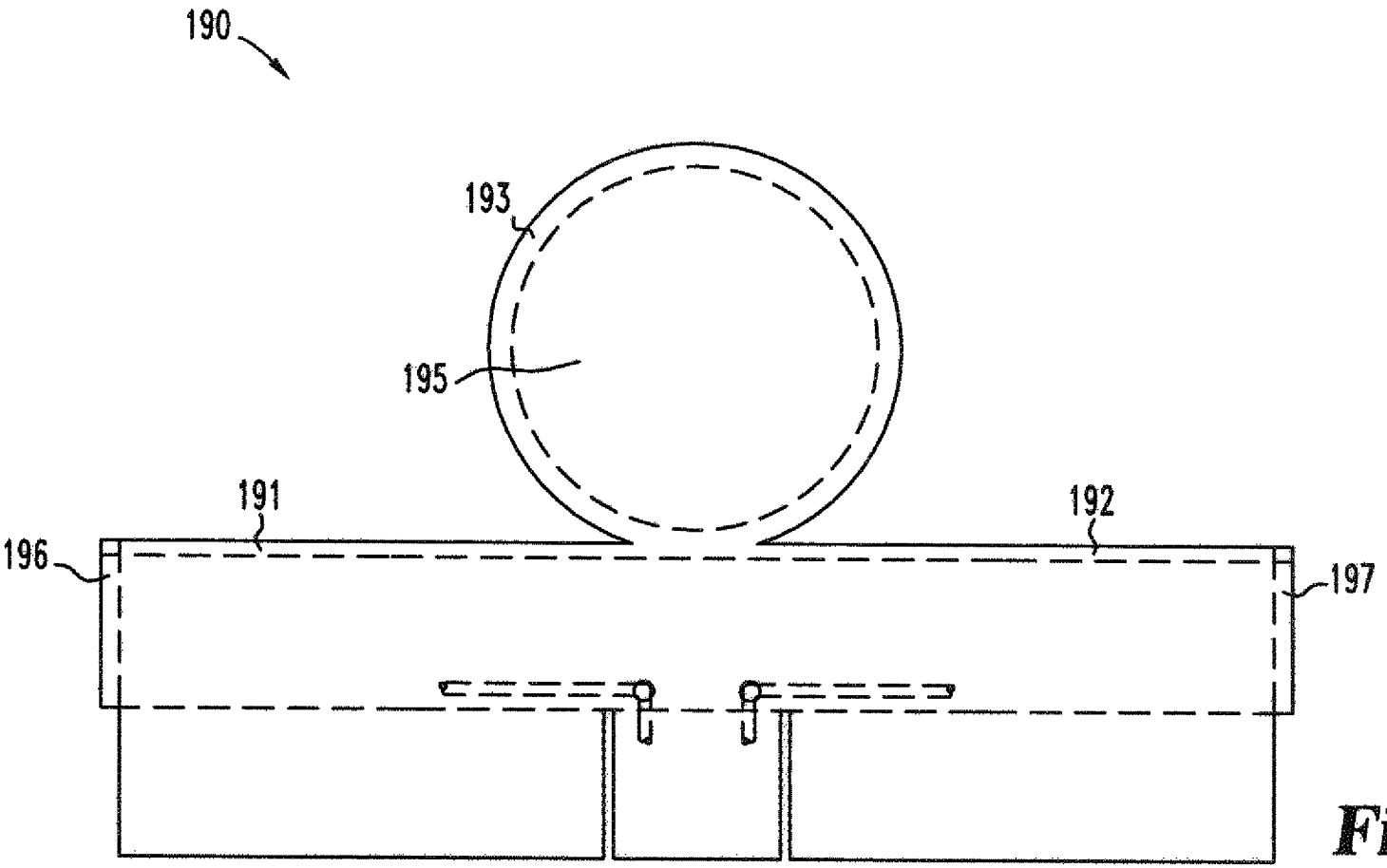
FIG. 22 is a plan view of a blank 190 that is formed to create lids 101 of FIG. 10 and lid 104 of FIG. 14 in accordance with another embodiment of the present invention.

Referring to FIG. 21, there is shown a single blank 180 in accordance with another embodiment of the present invention. Blank 180 is a combination of the blanks 105 and 106 with blank 106 simply inverted and already connected to the top of the circular top portion 107. In FIG. 22, there is shown a single blank 190 in accordance with another embodiment of the present invention. Blank 190 is a combination of the blanks 105 and 106 with the material of blank 106 simply added to laterally extend the rectangular portion 111 of blank 105 an amount equal to the width of blank 106. Blank 190 is folded and sewn (or glued, etc.) just like the blanks 105 and 106, except that the left and right top outer seam portions 191 and 192, which are of course wider than seam portions 112 and 113, are secured each to the opposing left and right sides (all as viewed in FIG. 21) of the circular seam portion 193 of the circular top portion 195, and side seam portions 196 and 197 are secured together, all to form the desired lid member like lid 104 of beverage insulation system 102.

Alternative embodiments are contemplated wherein the dimensions of the various components of the beverage insulation systems described are modified to adapt such beverage insulation systems to work with cans of varying sizes.

Embodiments of beverage insulation systems 10 and 80 are contemplated to include all or fewer than all the features described herein. For example, embodiments of the invention may include both or just one of the insert 46 and the lever 55, or embodiments of the invention may include the hinge assembly 82 and both or just one of the insert 46 and the lever 55.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A beverage insulation system for holding a beverage can, the beverage can having a lower portion, an upper portion and a greater diameter, the beverage insulation system comprising:

a base with thermally insulated walls and a bottom that together form a base cup sized and configured to receive the lower portion of the beverage can;

a lid with thermally insulated walls and a top that together form a lid cup sized and configured to receive the upper portion of the beverage can;

a hinge assembly connecting said lid with said base to enable said lid to pivot between a closed position covering the upper portion of the beverage can received in the base cup and an open position uncovering the upper portion; and a generally cylindrical insert having an inner surface and being coaxially gripped and held within and by the thermally insulated walls of the lid cup to encircle the upper portion of the beverage can received in the base cup and in the closed position.

2. The beverage insulation system for holding a beverage can of claim 1 wherein at least the inner surface is plastic.

3. The beverage insulation system for holding a beverage can of claim 1 wherein at least the inner surface has a Mohs number of at least 4.0.

4. The beverage insulation system for holding a beverage can of claim 3 wherein at least the inner surface has a Mohs number of at least 5.0.

5. The beverage insulation system for holding a beverage can of claim 1 wherein said insert has a height of at least 0.5 inches.

6. The beverage insulation system for holding a beverage can of claim 5 wherein the height of the insert is at least 1.0 inches.

7. The beverage insulation system for holding a beverage can of claim 1 wherein said insert is cylindrical.

8. The beverage insulation system for holding a beverage can of claim 1 wherein said lid is made of a flexible, spongey material.

9. The beverage insulation system for holding a beverage can of claim 8 wherein said lid is made from a blank comprising one of neoprene and scuba.

10. The beverage insulation system for holding a beverage can of claim 1 wherein said hinge assembly includes a hinge strap securely connected at one end to said base and at an opposing end to said lid.

11. The beverage insulation system for holding a beverage can of claim 10 wherein the walls of said base and said lid each have an outside and the hinge strap is connected to the outsides of said base and said lid.

12. The beverage insulation system for holding a beverage can of claim 10 wherein the walls of said base and said lid each have an inside and the hinge strap is connected to the inside of at least one of said base and said lid.

13. The beverage insulation system for holding a beverage can of claim 1 wherein said hinge assembly includes an anchor plate and a hinge strap securely connected at one end to the anchor plate and at an opposing end to said lid.

14. The beverage insulation system for holding a beverage can of claim 13 wherein the anchor plate is plastic.

15. The beverage insulation system for holding a beverage can of claim 14 wherein the anchor plate has a radius of curvature of about 1.3 inches.

16. The beverage insulation system for holding a beverage can of claim 1 further including a finger lever with a lever portion held by and extending outwardly of said lid.

17. The beverage insulation system for holding a beverage can of claim 16 wherein the walls of said lid define a generally cylindrical body with inner and outer surfaces and said finger lever also includes a circular portion connected with the lever portion and positioned to be generally coaxial with the generally cylindrical lid body and inside of the outer surface of the generally cylindrical lid body.

18. The beverage insulation system for holding a beverage can of claim 17 wherein said finger lever is a rod having first and second ends and extending from its first end comprising a part of the lever portion outside the lid to and comprising the circular portion inside the outer surface of the generally cylindrical lid body and thence back outwardly of the lid to and comprising a part of the lever portion.

19. The beverage insulation system for holding a beverage can of claim 18 wherein said finger lever further includes a finger member connecting the first and seconds ends.

20. The beverage insulation system for holding a beverage can of claim 18 wherein said lid comprises at least one foam blank folded into a cup shape and to wrap around and hold the circular portion.

21. A beverage insulation system for holding a beverage can, the beverage can having a lower portion, an upper portion and a greater diameter, the beverage insulation system comprising:

a base with thermally insulated walls forming a base cup;

a lid with thermally insulated walls forming a lid cup;

a hinge assembly connecting said lid with said base to enable said lid to pivot between a closed position covering the upper portion of a beverage can received in the base cup and an open position uncovering the upper portion of a beverage can received in the base cup; and an insert gripped and held within and by the thermally insulated walls of the lid cup to encircle the upper portion of a beverage can received in the base cup and in the closed position.

22. A method for insulating a beverage can, the beverage can having a lower portion, an upper portion and a greater diameter, the method comprising the steps of:

providing a beverage insulation system for holding a beverage can, the system including a base with thermally insulated walls and a bottom that together form a base cup sized and configured to receive the lower portion of the beverage can; a lid with thermally insulated walls and a top that together form a lid cup sized and configured to receive the upper portion of the beverage can; a hinge assembly for connecting the lid with the base to enable the lid to pivot between a closed position covering the upper portion of a beverage can received in the base cup and an open position uncovering the upper portion of a beverage can received in the base cup; and a generally cylindrical insert having an inner surface;

hingedly connecting the lid with the base using the hinge assembly;

positioning the insert into the lid cup to a generally coaxial position with and inside of the lid cup whereby the insert is gripped and held by the thermally insulated walls of the lid cup;

with the lid in the open position, inserting a beverage can into the base cup; and hingedly pivoting the lid down to the closed position over the upper portion of the beverage can whereby the insert encircles the upper portion of the beverage can.

23. The method for insulating a beverage can of claim 22 wherein said providing step includes the insert having a height of at least 0.5 inches.

24. The method for insulating a beverage can of claim 22 wherein said providing step includes said hinge assembly including a hinge strap securely connected at one end to said base and at an opposing end to said lid.

25. The method for insulating a beverage can of claim 22 wherein said providing step includes further includes the beverage insulation system including a finger lever with a lever portion connected with and extending outwardly of said lid.

* * * * *